United States Patent [19]

Bridges et al.

[11] Patent Number: 4,790,375

[45] Date of Patent: Dec. 13, 1988

[54] MINERAL WELL HEATING SYSTEMS

[75] Inventors: Jack E. Bridges, Park Ridge; Guggilam C. Sresty, Burbank, both of Ill.; Vincent R. Young, Tulsa, Okla.; Homer L. Spencer, Calgary, Canada

[73] Assignee: ORS Development Corporation, Tulsa, Okla.

[21] Appl. No.: 123,931

[22] Filed: Nov. 23, 1987

[51] Int. Cl.[4] ..... E21B 36/00; E21B 43/00

[52] U.S. Cl. ..... 166/60; 166/304; 166/902; 166/62; 219/277

[58] Field of Search ..... 166/57, 60, 62, 65.1, 166/304, 902; 219/277, 278

[56] References Cited

U.S. PATENT DOCUMENTS

| | | | |
|---|---|---|---|
| 2,244,255 | 6/1941 | Looman . | |
| 2,982,354 | 5/1961 | Green | 219/277 X |
| 3,614,986 | 10/1971 | Gill . | |
| 4,319,632 | 3/1982 | Marr, Jr. | 166/60 |
| 4,495,990 | 1/1985 | Titus et al. | 219/277 X |
| 4,522,262 | 6/1985 | Perkins | 166/60 X |
| 4,716,960 | 1/1988 | Eastlund et al. | 166/60 |

OTHER PUBLICATIONS

Production Increase of Heavy Oils by Electro Magnetic Heating, Abernethy, May 1974.

A Novel Approach to Solving Downhole Fluid Flow Problems by use of an Electric Heating System, IEEE, 1985.

AC Current Heats Heavy Oil for Extra Recovery, World Oil, May 1970.

The Electrothermic System for Enhancing Oil Recovery, Journal of Microwave Power, 1983.

Unique Electrothermic Recovery Method gets Rocky Mountain Test, The Oil and Gas Journal, Dec. 1969.

Influence of Adjacent Conductive Formations on the Selective Electric Reservoir Heating Process, Society of Petroleum Engs., 10-1982.

Electroflood Proves Technically Feasible, Petroleum Engineer International, Jan. 1980.

Selective Electric Reservoir Heating, The Journal of Canadian Petroleum, Jul. 1979.

A Radial Model for Estimating Heat Distribution in Selective Electric Reservoir Heating, The Journal of Canadian Petro. 10-1980.

Well Stimulation by Downhole Thermal Methods, Petroleum Engineer, Oct. 1973.

*Primary Examiner*—Jerome W. Massie, IV

*Assistant Examiner*—William P. Neuder

*Attorney, Agent, or Firm*—Kinzer, Plyer, Dorn, McEachran & Jambor

[57] ABSTRACT

Heating systems for mineral wells (e.g. oil wells) employ electrical power sources, sometimes operating at relatively high frequencies, that are connected to the well casing and production tubing so as to provide a coaxial line electrical heater projecting down into the well. The heating pattern of the coaxial line is effectively controlled so that most of the power is dissipated as heat, primarily in the tubing, above a depth D above which paraffins or other condensible constituents would tend to condense or otherwise impair the flow of mineral fluid up through the production tubing. The applied electrical power is controlled so that the fluid is kept approximately at or only somewhat above the flow impairment temperature for constituents of the fluid. In some embodiments the system is extended to provide heating of a portion of the deposit formation adjacent to the well.

56 Claims, 5 Drawing Sheets

30
39
41
FROM PUMP MECHANISM
66
34
FLOW RATE SENSOR
35
34
36
LIQUID
65
GASKET 42
44
40
POWER CONTROL CIRCUIT
ELECTRICAL POWER SOURCE (A.C.)
47
INSULATOR STUB 33
37
20
31
32
46
GAS
45
SURFACE 22
THERMAL INSULATION 59
21
43
AQUIFER 49
37C
67
INSULATOR 43
CASING 26
5
5
D
OVERBURDEN 23
43
PRODUCTION TUBING 37
CEMENT 27
69
3
3
ELECTRICAL CONNECTOR 48
29
27
OVERBURDEN 23
21
DEPOSIT (RESERVOIR) 24
28
PUMP
28
38
37B
UNDER BURDEN 25
26
21B

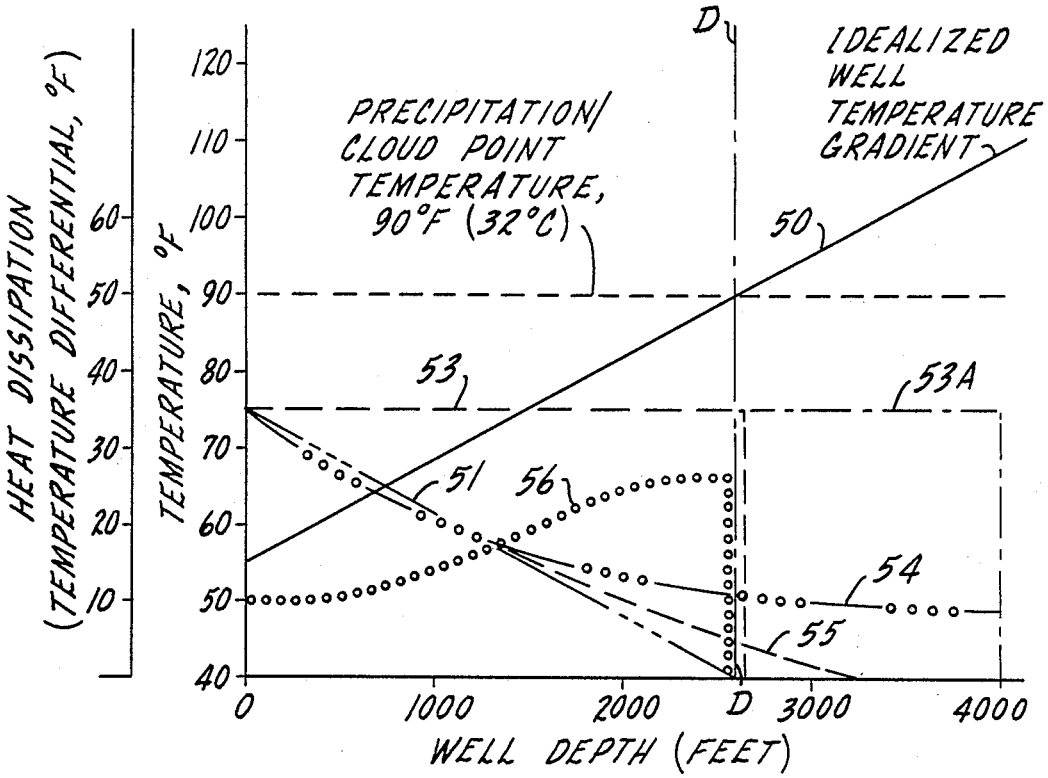
fig. 2.
fig. 3.
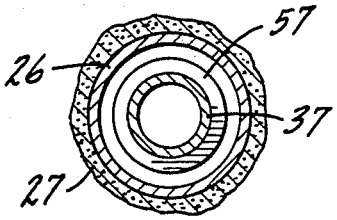
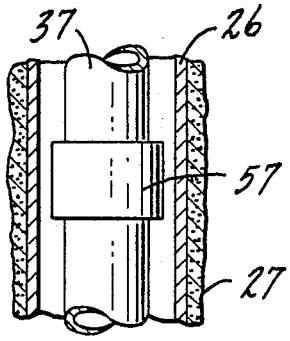
fig. 4.
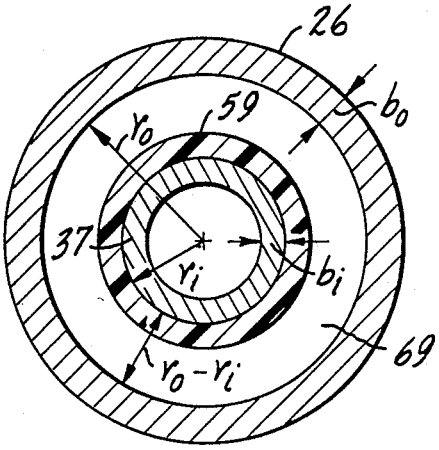
fig. 5.

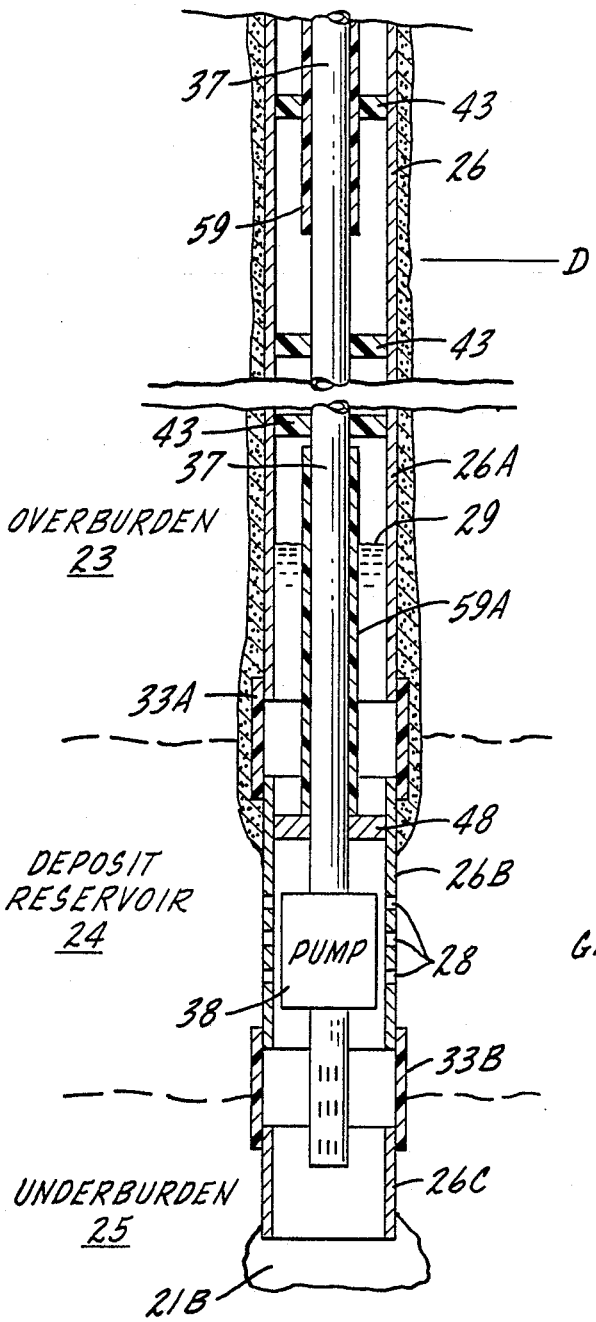
Fig. 8.
Fig. 9.
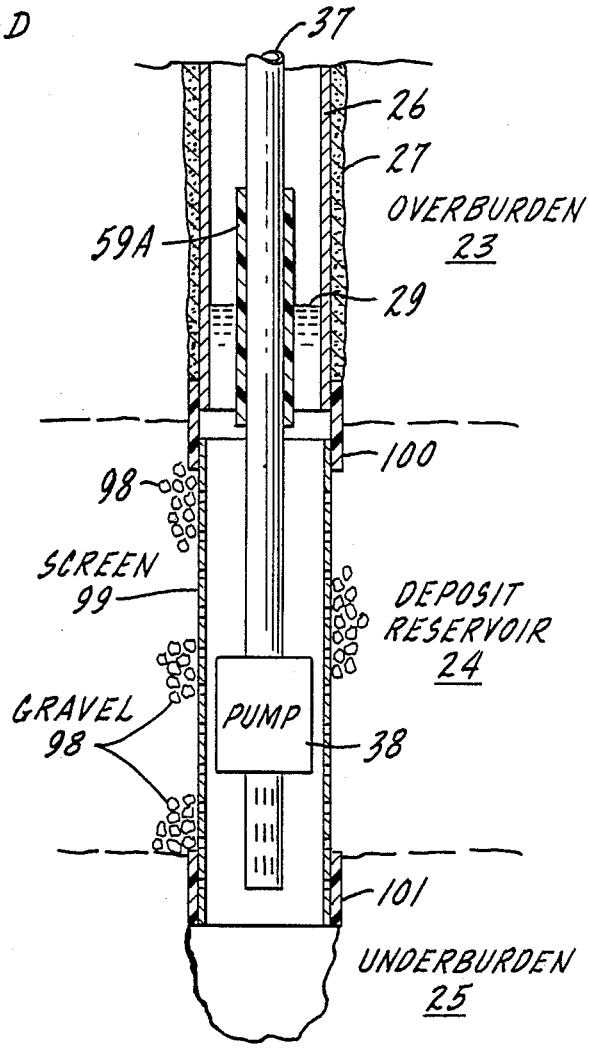

MINERAL WELL HEATING SYSTEMS

BACKGROUND OF THE INVENTION

Most petroleum deposits contain constituents that would be solids or near-solids at ordinary room temperatures. For many lighter grades of petroleum, these constituents are primarily paraffins. In other deposits, these fractions may be mostly asphalts. For either type of petroleum, these constituents tend to condense from the fluid flow as it moves upwardly in a well through the usual production tubing. That is, the heavier fractions tend to precipitate as the fluid cools on its way toward the surface, moving into increasingly cooler regions; these fractions tend to accumulate in the production tubing and limit the production rate. Accumulations of paraffin in and on the production tubing may stop flow entirely. Similar problems are encountered in wells producing heavy crudes that become highly viscous as the fluid cools in its movement toward the surface.

The term "condensible constituents", as used herein, includes paraffins, asphalts, and any other constituents that tend to coagulate, condense, precipitate, or otherwise accumulate in the cooler portions of a mineral well. Action must frequently be taken to clear accumulations of such condensible constituents and restore the well to normal operation. Similar problems occur in other mineral wells having a substantial sulphur content in the fluids produced.

Paraffin precipitation problems may be quite severe in shallow wells with producing formation (reservoir) temperatures that are only slightly above the temperatures at which accumulations of condensible constituents occur. The expansion in the volume of fluids that occurs during petroleum production cools the fluids sufficiently to cause condensation. Such condensation causes plugging of the perforations in the well casing and of pore spaces in the reservoir, in addition to accumulating in the tubing as described above. Action must frequently be taken to remove the accumulated paraffin. Similar problems also occur with deep sour gas wells in which accumulation of sulfur in the reservoir and/or tubing causes rapid decline in the fluid production rate. Accumulation of sulfur in such wells is believed to be due to changes in both the physical state and chemical composition of the fluid as it cools during expansion in the wellbore region or as it moves upwardly through the production tubing. Thus, in such wells sulphur is a "condensible constituent".

In gas wells, mixtures of hydrocarbons and water vapor, upon a change in pressure or a decrease in temperature, may form hydrate crystals which can block the flow of the desired fluids. Other gas wells produce small amounts of heavy, viscous oils which condense in the cooler zones and tend to decrease production. Expansion of gases, evaporation of volatiles and decrease in temperature near the earth surface are largely responsible for the condensation/accumulation phenomena occurring in these wells. Again, such accumulations constitute "condensible constituents" from the fluids produced by the wells.

A variety of techniques have been proposed to mitigate, eliminate, or correct the effects of precipitation of paraffins or the accumulation of other condensible constituents within the production tubing of oil wells, gas wells, and other mineral wells. Thus, a variety of knives and scrapers have been tried for mechanical removal of accumulations from the production tubing. These scrapers are sometimes attached to the pump rods of the wells; in other instances, it is necessary to remove the pump rod to permit insertion of the scrapers to cut loose accumulated deposits of paraffin, asphalt, or the like. In some proposals, a solvent or diluent is utilized to loosen the paraffin or other condensible constituents from the interior of the production tubing so that they can be pumped to the surface. Solvents are also sometimes injected into the producing formation (reservoir) to dissolve paraffin accumulated in the casing perforations and reservoir pore spaces. In viscous oil wells, diluents are often added to reduce pumping difficulties. In most of these systems, the well must be shut down, adding to the expense of reworking the well to clean out deposits within the production tubing.

Electrical heating systems have also been proposed as a cure for condensation of paraffin, asphalt and other condensible constituents in mineral wells such as oil wells, gas wells, and the like. In some of these systems, a discrete electrical heater is positioned downhole in the well, frequently at or near the level of the deposit from which mineral fluid is being drawn, and is energized from an electrical cable. Such discrete heaters, while useful, only heat a portion of the tubing and rely on the flow of crude to heat the remainder of the tubing. Except for quite high flow rates, this effectively heats only about thirty to fifty meters of tubing above the heater. Also, cable life within a mineral well tends to be quite short and frequent replacement of the cable, at substantial expense, becomes a necessity. Keeping the heating equipment in operation is also quite difficult; burnouts are relatively frequent.

Other proposed systems are directed to the removal of paraffin deposits after condensation, with the production tubing and well casing utilized as active components in a heating system. An early example of a system of this kind is described in Looman U.S. Pat. No. 2,244,255 for "Well Clearing System". In that system a motor generator or specially built transformer has one lead connected to the production tubing and the other to the well casing. The casing and tubing are insulated from each other except in a lower part of the well, where a sliding electrical contact is established between the tubing and the casing to define a lower limit for a heating zone. The overall system requires high currents and high power dissipation; the only example requires a current of 750 amperes and a power (heat) dissipation rate of 37.5 kilowatts. The system is energized periodically to melt the paraffin accumulations within the production tubing and is then turned off to permit normal operation of the well.

A similar system is described in Green U.S. Pat. No. 2,982,354 for "Paraffin Removing Device", which utilizes a timing control or an energization control responsive to the output of a strain gauge connected to the pump rod. Green's system periodically supplies a large surge of power to melt the paraffin. Yet another similar system is disclosed in Marr U.S. Pat. No. 4,319,632 for "Oil Recovery Well Paraffin Elimination Means". The objective of the Marr arrangement is to heat the casing above the melting point of the paraffin. The heating current flows primarily through an insulated cable attached to the well casing. This causes much of the heat to be dissipated in the casing and lost to surrounding ground formations. The Marr arrangement has the further disadvantage that its power cable is subject to the service difficulties noted above.

A rather different technique for attacking the paraffin condensation problem is described in Gill U.S. Pat. No. 3,614,986 for "Method of Injecting Heated Fluids into Mineral Bearing Formations". In that system a hot liquid (oil) is periodically pumped into the well to melt or dissolve any accumulations of paraffin or other condensible constituents, after which the well is restored to operation. To keep the heat loss in a deep well from defeating the purpose of the hot oil injection, the Gill system provides an electrical heating arrangement like those described in the Looman and Green patents, but only for the purpose of compensating for heat losses experienced by the downwardly flowing heated liquids. As in the other systems discussed above, the Gill arrangement is intended to melt or dissolve the paraffin or other condensate accumulations with the well shut down (for the injection of hot fluids), following which normal operation is restored until a subsequent clean-out is required.

In another known method a heating tape is attached to the production tubing. This technique can achieve heating in a short period of time, but the system is inconvenient to install and, if rework is required, the heating tape must be detached from the tubing and collected on a separate reel. A special well-top header is required to allow a multi-conductor electrical power cable to pass through the header for connection to the heating tape within the annulus between the tubing and the casing. Long term deterioration of the cabling in the hostile environment of a downhole system can be anticipated from both the chemical constituents of the fluids and mechanical movements of the tubing. The downhole tubing expands and contracts not only with temperature but also with the forces associated with pumping. Such forces can cause the tubing to rub against the wall of the casing, which can cause rapid deterioration of the heating tape. Manufacturers of such tape systems recommend that the tubing system be held at temperatures about 10° to 20° F. (5° to 10° C.) above the pour point of the oil. For many high-gravity paraffin prone oils, holding the tubing temperature no more than 20° F. above the pour point could result in substantial paraffin precipitation.

SUMMARY OF THE INVENTION

It is a principal object of the present invention, therefore, to provide a new and improved electrical well heating system for a mineral well of the kind in which condensible constituents accumulate from a flow of fluid moving upwardly through a portion of the well, a heating system that imposes minimal power requirements, that permits the well to remain in continuous operation, and that effectively utilizes the thermal properties of the tubing, the casing, and the adjacent earth formations as well as the physical and chemical characteristics of the condensible constituents in the mineral fluid.

A related object of the invention is to provide a new and improved mineral well heating system for preventing accumulation of condensible constituents from a flow of mineral fluid moving upwardly through a portion of the well, a system in which the spatial power distribution is optimized by appropriate selection of the material for the production tubing used as the main heating element, of the frequency of electrical excitation, and of termination of the heating system by appropriate means at an optimum location in the well.

Another object of the invention is to provide a new and improved mineral well heating system for preventing accumulation of condensible constituents from a flow of mineral fluid moving upwardly through a well, a system in which the spatial power distribution in the well and in the region around the casing in the reservoir is optimized by appropriate selection of the production tubing used as the main heating element, of the electrical heating and contact system between the production system and the the reservoir, and of the frequency of electrical excitation.

A specific object of the invention is to utilize previously unrecognized properties of ordinary carbon steel tubing, frequently used for the well casing and production tubing in mineral fluid wells, in electromagnetic heater systems that preclude accumulation of condensible constituents from a flow of mineral fluid moving upwardly to the surface of the well.

Accordingly, the invention relates to a well heating system for a mineral well of the kind in which a flow of a mineral fluid moving upwardly above a predetermined subsurface depth D is subject to impairment due to condensation of paraffin or other condensible constituents from the fluid flow or to increasing viscosity of the fluid, the well comprising a well bore projecting downwardly from a surface to a fluid reservoir and having an electrically conductive outer wall, and an electrically conductive production tubing extending down into the well bore in physically spaced and electrically insulated relation to the well bore wall. The heating system comprises an electrical power source and connection means for electrically connecting the power source to the tubing and to the electrically conductive wall so that the tubing and wall conjointly afford a two-conductor heating apparatus projecting downwardly into the well bore, which heating apparatus functions electrically approximately as a coaxial line. The heating system further comprises means for effectively terminating the coaxial line so that most of the electrical power supplied to the coaxial line from the power source is dissipated within the well above the depth D, and control means for controlling the electrical power supplied to the coaxial line from the power source to maintain the mineral fluid flowing in the tubing approximately at or above the flow impairment temperature for the fluid without substantially exceeding a predetermined upper limit temperature for the fluid in more than a minor fractional part of the well from depth D to the surface.

BRIEF DESCRIPTION OF THE DRAWINGS

FIG. 2 is a graph of well temperatures and of different spatial distribution patterns for heat dissipation, both as functions of well depth, applicable to the heating system of FIG. 1 and certain variations of that system;

FIG. 3 is a detail sectional view taken approximately as indicated by line 3—3 in FIG. 1, illustrating a variation of the heating system;

FIG. 4 is sectional elevation view of the apparatus shown in FIG. 3;

FIG. 5 is a sectional view taken approximately along line 5—5 in FIG. 1, utilized to identify certain factors relating to a mathematical analysis of the heating system of the invention;

FIGS. 8 and 9 are simplified schematic sectional elevation views of downhole portions of mineral wells equipped with heating systems constructed in accordance with other embodiments of the present invention.

DESCRIPTION OF THE PREFERRED EMBODIMENTS

Figure 1:
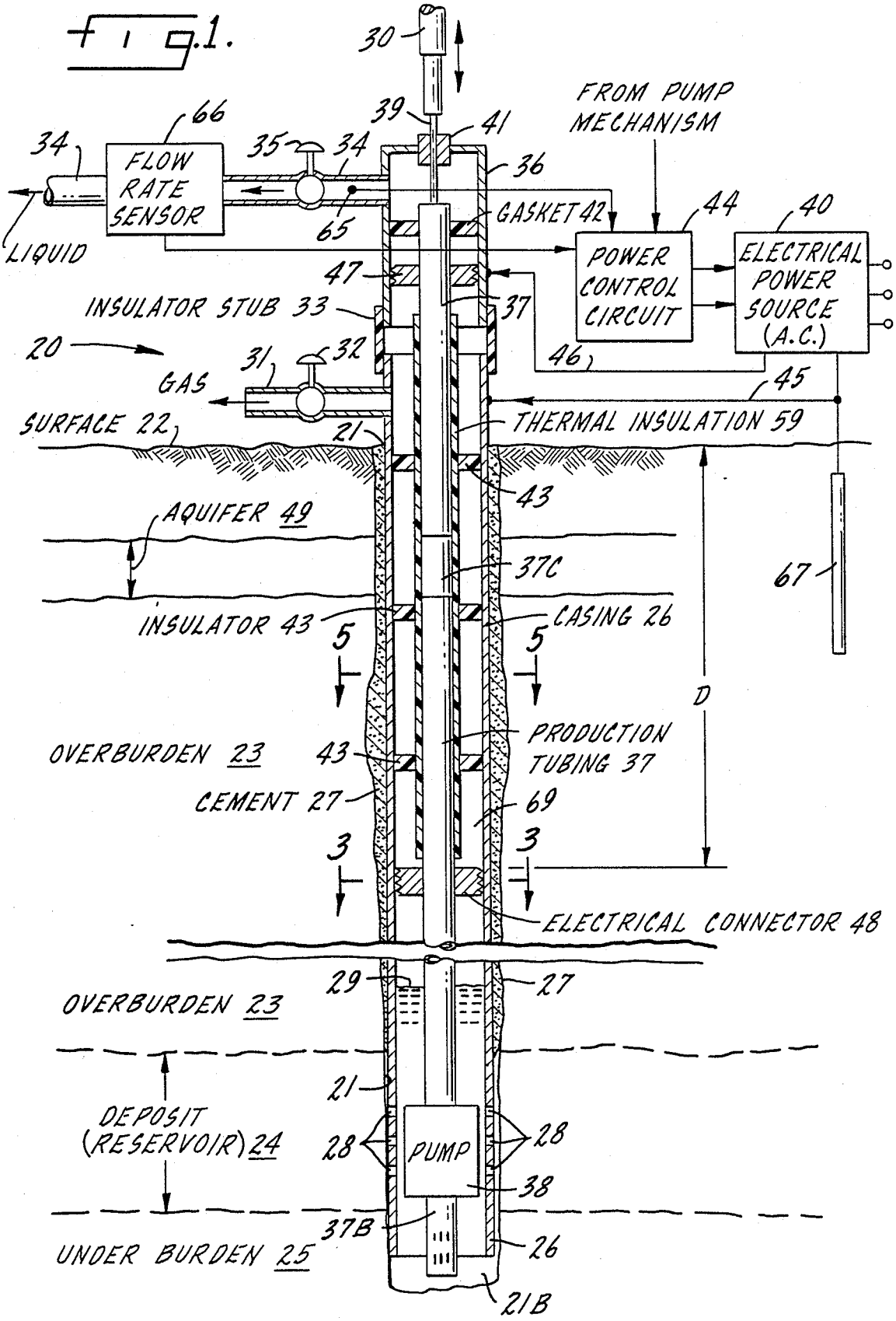
FIG. 1 is a simplified schematic sectional elevation view of a mineral well equipped with a heating system constructed in accordance with one embodiment of the present invention.

FIG. 1 illustrates a mineral well 20, specifically an oil well of the kind in which paraffins, asphalts, or other condensible constituents of a mineral fluid (e.g., petroleum) tend to condense, coagulate, precipitate, or otherwise accumulate from a flow of the fluid upwardly through a portion of the well. The condensible constituents accumulate and ultimately impair or even block the fluid flow within the well. Whether the impairment blockage results from precipitation, coagulation, or some other physical mechanism is not critical; prevention of accumulations leading to a reduction or blockage of flow in the well is the critical factor to which this invention is directed. "Condensation" and "condensible", as used in this specification, are intended to include coagulation, precipitation, or any other similar effect.

Well 20 comprises a well bore 21 projecting downwardly from a surface 22 through an extensive overburden 23 that may include a variety of different formations. Bore 21 of well 20 extends downwardly through a mineral deposit or reservoir 24 and may extend into an underburden 25. Well 20 is utilized to draw a mineral fluid, in this instance petroleum, from the deposit or reservoir 24 and to pump that fluid up to surface 22. An electrically conductive casing 26 extends downwardly into well bore 21 from surface 22, effectively lining the well bore. Well 20 may include cement 27 around the outside of casing 26. In well 20, casing 26 is shown as projecting down almost to the bottom of well bore 21, although a limited additional portion 21B of the well bore is illustrated as extending beyond the bottom of casing 26. The portion of well casing 26 aligned with deposit 24 includes a plurality of perforations 28 (it may be a screen); perforations 28 admit the mineral fluid (petroleum) from deposit 24 into the interior of the well casing. Petroleum may accumulate within casing 26, up to a level above deposit 24, as indicated at 29.

A gas outlet conduit 31 is connected to well casing 26 above surface 22. Conduit 31 may be provided with an appropriate valve 32. At its top, casing 26 is connected to a well head (cap) 36 by a tubular insulator stub 33. The casing cap 36 is connected to a liquid discharge conduit 34 which may be equipped with a control valve 35.

Well 20, FIG. 1, further comprises an elongated production tubing 37 that extends downwardly from within well head 36 through the full depth of casing 26 to a pump 38. A terminal section 37B of the production tubing may extend below pump 38. At the top of well 20 a pump rod or plunger 39 projects downwardly into production tubing 37 through a bushing or packing element 41 in well head 36. Rod 39, which is not shown in full for simplicity, may be mechanically connected, as by an electrical insulator, to an operating element 30 of a conventional pumping mechanism (not shown). The lower end of rod 39 (not shown) actuates pump 38.

In the preferred construction for well 20, production tubing 37 is conventional carbon steel tubing. In a typical well, tubing 37 may have a diameter of approximately two inches (five cm). The overall length of tubing 37, of course, is dependent upon the depth of well bore 21 and is subject to wide variation. Thus, the total length for tubing 37 may be as short as 200 meters or it may be 1500 meters, 3000 meters, or even longer.

At the top of well 20, within cap 36, a gasket 42 is interposed between the casing cap and production tubing 37 in a fluid-tight seal. This makes it possible to pipe off a mineral liquid (petroleum) that has been pumped upwardly through tubing 37, through liquid collection conduit 34 and thence to a pipeline or storage facility. Gasket 42 also serves to maintain production tubing 37 approximately centered within casing cap 36. Further down in well 20, a series of annular electrical insulators 43 serve the same basic purpose, positioning production tubing 37 approximately coaxially within casing 26 and maintaining the two in effective electrically insulated relationship to each other. However, the annular insulator members 43 preferably do not afford a fluid-tight seal at any point; rather, they should allow gas to pass upwardly in casing 26 around the outside of tubing 37 so that the gas can be drawn off through valve 32 and conduit 31.

As thus far described, well 20 is essentially conventional in construction. Its operation will be readily understood by those persons involved in the mineral well art, whether the wells are used to produce liquid petroleum, natural gas, or some other mineral fluid. Well 20, however, is equipped with a heating system and that heating system is the subject of the present invention.

The well heating system illustrated in FIG. 1 includes an electrical power source 40, preferably an alternating current source, that is connected to casing 26, to production tubing 37, and to a power control circuit 44. One power lead 45 from power source 40 is electrically connected directly to the top of casing 26. The other power lead 46 from source 40 is electrically connected to casing cap 36. Cap 36, however, is maintained in solid electrical connection with tubing 37 by an annular connector device 47 that affords a molecular bond connection both to tubing 37 and to casing cap 36. Such a connector can also be used to support the tubing string. As will be apparent from FIG. 1, casing 26 and tubing 37 conjointly afford a two-conductor heating apparatus that projects downwardly into well bore 21, a heating apparatus that functions electrically approximately as a coaxial line. If casing 26 is not present, or is electrically interrupted, the tubing 37 and well bore 21 nevertheless afford a coaxial line heating apparatus if the wall of the well bore has reasonable conductivity and if a ground lead (e.g., 45) is connected to an earthing rod such as rod 67.

In the system of FIG. 1, however, the coaxial heater line afforded by casing 26 and tubing 37 does not extend all of the way down to the bottom 21B of the well bore. Instead, the heating system includes means for effectively terminating the coaxial line heater apparatus at or near a preselected subsurface depth D. The termination may comprise an electrical connector 48, affixed to tubing 37, that projects outwardly to afford a solid, sound, molecular bond electrical connection to casing 26. An effective molecular bond type electrical connection may be obtained with oil well anchor-catchers available in the industry, such as those from Baker Service Tools, Models B-2 and B-3. Connectors 47 and 48, in addition to their electrical functions, may be constructed and arranged to hold much of tubing 37 in tension to avoid buckling from expansion during heating or from mechanical stress incurred from the weight of the tubing or from pumping action.

Selection of the level for termination of the coaxial line heating apparatus by electrical connector 48, or by other means as described hereinafter, depends upon several factors. In virtually any mineral well of substantial depth, there is an appreciable temperature gradient from the hottest point in the well, usually at the bottom 21B of the well bore, up to surface 22. The temperature gradient is not likely to be linear; it may change appreciably and rather abruptly at varying levels depending upon the nature of underburden 25, reservoir 24, and the various formations making up overburden 23. The presence or absence of an aquifer, such as the aquifer 49 indicated in FIG. 1, and the thermal characteristics of the aquifer (e.g. conductivity, convection, water temperature, etc.) may cause a substantial discontinuity in the thermal gradient and in the heat required to prevent condensation. The thermal properties of reservoir 24 and the fluid in the reservoir, casing 26, and tubing 37, as well as the rate of fluid flow in tubing 37 and in the annulus 69 between the tubing and casing 26, all affect the temperature gradient from 21B to 22 when well 20 is in operation.

In virtually any deep petroleum well there is an upper portion of the well, from surface 22 down to the subsurface depth D, within which temperatures of the fluid flowing within tubing 37 are likely to drop low enough to initiate condensation and precipitation of paraffins or similar action with respect to other condensible constituents of the petroleum. It is in the section of well 20 from surface 22 to depth D that the condensible constituents may condense or coagulate and may accumulate to an extent sufficient to impair normal operation of the well. Ultimately, these accumulations block the fluid flow, increase pumping power requirements, and eventually force shutdown of the well. In some shallow wells heating of the full length of tubing 37 may be necessary, in which case depth D extends into the reservoir formation 24.

In the prior art concepts, accumulations of condensible constituents are removed by any one of a variety of different techniques, including scraping, melting or dissolving by hot fluid injection, or melting by electrical heating, all with well 20 shut down, following which normal operations are resumed until the output of the well is again severely inhibited or even blocked by condensate accumulations.

As an example, consider a paraffin-containing oil well which is 1212 meters (4000 feet) deep and which has a cloud point of 32° C. (90° F.). The producing zone temperature is 43° C. (110° F.) and the temperature of the overburden decreases 7.6° C. (13.8° F.) for every 303 m. (1000 ft.) decrease in depth. Assuming a low fluid flow rate, the temperature of the tubing at a depth D of about 660 m. (2600 feet) equals the cloud point, the point at which paraffin particles begin to precipitate visibly. Above this depth, the temperature of the tubing drops increasingly below the cloud point, such that near surface 22 the tubing temperature is only 13.2° C. (55° F.), about 16.7° C. (35° F.) below the cloud point, thus causing substantial precipitation of paraffin in the tubing.

Initially, when the well of this example is first placed in production, the fluid level 29 in the well is substantially above deposit 24 (FIG. 1). The presence of such fluid increases the thermal conductivity between the tubing 37 and casing 26. The presence of such fluid, if reasonably conductive electrically may also provide an unwanted electrical path if it is desired to heat a substantial length of tubing 37 below the surface 29 of the reservoir fluid within the annulus 69. Typically, as the well is maintained in production, the fluid level 29 of the reservoir fluid drops, but may remain more than about one hundred meters or a few hundred feet above the deposit.

A typical paraffin-containing oil may have an API of 39° and may hold about 5.3% wax in solution so long as the temperature of the oil exceeds 32° C. (90° F.), taken as the approximate cloud point. If the temperature of the oil is 12.8° C. (55° F.), only 4.55% of the paraffin can remain in solution. If the produced fluids are chilled to 12.8° C. (55° F.), about 0.75% of the weight of the oil is precipitated as wax. While this seems a small number, the cumulative amount is large and represents, for a well producing thirty barrels a day, a total precipitation of about one-fourth a barrel of wax per day. Even if only a fraction of the precipitated paraffin remains in tubing 37, the tubing can be clogged with wax in only a few days.

Typically, the saturation temperature, which is approximately the same as the cloud point temperature, is much lower than the melting point of the paraffin wax. The melting point of wax from 39° API crude is loosely related to the cloud point as follows:

TABLE I

| Saturation Temperature 5.3% Wax | Melting Point Temperature |
|---|---|
| 15.6° C. (60° F.) | 52° C. (126° F.) |
| 32° C. (90° F.) | 67° C. (153° F.) |
| 42° C. (108° F.) | 74° C. (165° F.) |
| 49° C. (120° F.) | 80° C. (176° F.) |
| 57° C. (135° F.) | 87° C. (189° F.) |

(From Paraffin and Congealing-Oil Problems, C. E. Reistle and O. C. Blade, Bulletin 348, U.S. Bureau of Mines, U.S. Government Printing Office, 1932).

Thus, the melting point of the paraffin averages approximately 33° C. (60° F.) above the cloud point for the oil produced in at least some oil fields. No assurance exists that similar data will hold true for other fields; however, the melting point is always significantly greater than the cloud point.

Because the melting point significantly exceeds the saturation temperature or cloud point, the power required to prevent precipitation is significantly less than the power needed to melt accumulated paraffin. This point was not fully appreciated in the prior art. While equipment to melt paraffin need only be actuated periodically, the size, weight, and cost of such equipment is large. Further, the intermittent peak power needed to melt the paraffin imposes a peak power handling capacity that is an appreciable burden for many rural power lines. Accordingly, the technique of melting paraffin accumulations results in large, expensive apparatus that requires either a large capacity motor-generator for the power source or a substantially modified rural electrical power distribution system.

Another point not fully appreciated in the past is that the cloud point for waxy crudes should not be confused with the pour point. If a crude oil is cooled in a thirty-five millimeter diameter test tube without agitation, a temperature is finally reached at which the oil will not flow from the test tube, within a reasonable time, when the tube is tilted into a horizontal position. This no-flow temperature is defined as the pour point. Typical paraffin-prone deposits exhibit oils with 36° to 42° API gravity. Wax-free oils of this gravity also exhibit pour points of −18° C. (0° F.) to 4.4° C. (40° F.). Continuing with the example of the previous paragraph, which discussed a 39° API oil that was just able to contain 5.3% wax at 32° C. (90° F.), assume that this solution is cooled to 29.5° C. (85° F.); 0.15% of the wax will be precipitated out while the rest (5.15%) remains in solution. It is obvious that the 0.15% by weight of paraffin particulates contained in the oil at 85° F. will not prevent the oil from being poured from the bottle. Assuming that the presence of the wax does increase the pour point somewhat to about 4.5° C. (40° F.), maintaining a temperature of about 10° C. higher than this at 15.5° C. (60° F. or 20° above the pour point) will still not prevent substantial precipitation of about 0.5% by weight of paraffin. Thus, maintaining a tubing temperature of about 10° C. (20° F.) above the pour point, as has been advocated, will not prevent precipitation and thus is not an appropriate design parameter.

In the heating system of FIG. 1, the electrical power supplied from source 40 to casing 26 and tubing 37 is regulated by control circuit 44 so that, throughout depth D, the mineral fluid in production tubing 37 is maintained approximately at or above the condensation temperature of the condensible constituents of that fluid. Furthermore, the power supplied to the coaxial line heater afforded by casing 26 and tubing 37 and terminated by connector 48 is so regulated that the melting point temperature of the condensible constituents is not substantially exceeded in any more than a minor fractional part of the heater within depth D. Indeed, it is much preferred that the temperature within tubing 37, which is the temperature to which the fluid flow is subjected, should always be below the melting point temperature of the paraffins or other condensible constituents in the fluid output from well 20.

The graphs afforded in FIG. 2 are intended to assist in understanding the spatial distribution that may be required or desirable for the power (heat) dissipation within well 20 as a function of the well depth down to the depth D. FIG. 2 assumes a well producing a paraffin-containing oil, the well having a total depth of 4,000 ft. (1,212 m) with a threshold condensation depth D of 2,600 ft. (787 m). Thus, the well bore temperature gradient would be as generally indicated by curve 50 from a maximum of 110° F. (43° C.) at the bottom of the well to 55° F. (13° C.) at the top. For a slowly producing well with uniform characteristics in all respects as assumed for the idealized well temperature gradient curve 50 (uniform composition of overburden 23, uniform casing 26, uniform tubing 37, etc.) the optimum spatial distribution for heat dissipation would also be linear, approximately as indicated by curve 51. The threshold precipitation/cloud point level D in the well is taken as 2,600 feet (787 m), where the cloud point temperature equals the well temperature.

If it is assumed that tubing 37 has a uniform impedance at the operating frequency of the AC electrical power source 40, at least down to depth D, if the electrical characteristics of casing 26 are also essentially uniform to the same depth, and if the operating frequency f of electrical power source 40 is relatively low (e.g., 60 Hz), then the heating system of FIG. 1 provides heat dissipation approximately in accordance with the operating characteristic indicated in FIG. 2 by line 53. If the heating system were not terminated at depth D by connector 48 (FIG. 1), heating would occur also in the lower part of the well as indicated by curve 53A. Either arrangement seems rather wasteful adjacent the bottom of the heating apparatus (near depth D for curve 53, at the well bottom for curve 53A) since there is more power dissipation at low depths than is necessary; see curve 51.

Actually, however, the magnitude of the spatial distribution of heat dissipation indicated by line 53 can be reduced somewhat. The continuing flow of fluid through tubing 37 carries some of the excess heat upwardly from near depth D, transferring that heat to the portion of the well adjacent surface 22. The efficiency of this transfer mechanism is markedly improved if tubing 37 is thermally insulated above depth D as indicated by the thermal insulation sleeve 59, FIG. 1. So long as power dissipation is maintained at a level below that required to melt the paraffins or other condensible constituents throughout most of depth D, the heating system can be more efficient and economical than the prior art arrangements that require melting of condensible constituents after they have been permitted to condense and accumulate. This is especially true for wells with relatively high production flow rates, which tend to carry considerable quantities of excess heat from depth D rapidly into the cooler zones near the surface 22. Moreover, the described system, even in its least efficient form, keeps well 20 in production; there are no paraffin cleanout shutdowns.

It is not necessary to settle for the uniform heating characteristic indicated by line 53 (or 53A) in FIG. 2; substantially closer approximations to curve 51 can be obtained.

At a high enough frequency, the coaxial heating apparatus afforded by casing 26 and tubing 37 presents a lossy transmission line situation. By the proper selection of the combination of tubing 37, casing 26, frequency f, and insulator spacers 43, the heat dissipation spatial distribution may be made to assume the form of an exponential decay, with progressively decreasing power dissipation with increasing depth. At the greater depths the choice of termination affects the spatial distribution. If the tubing is terminated at the bottom of the well, in this instance at a depth of 4000 feet (1212 meters), by an electrical connector like connector 48, the current wave is reflected additively, which gives rise to a flattened, tailed heat dissipation distribution curve 54. Curve 54, though it may be substantially more efficient than curve 53, still represents some power waste because of its noticeable dissipation in the lower part of the well, from depth D down to the well bottom, where no heating is necessary. Alternatively, an open circuit can be introduced to give a reflected (upward) current wave which substracts from the incident (downward) wave. If the open circuit, formed by insertion of an insulator section in tubing 37, is located at a depth of 3200 feet (969 m), then the spatial distribution curve 55 results.

For the example deposit discussed previously, it is seen in FIG. 2 that the heat dissipation in the tubing of a slowly producing well must cause a temperature rise of only 19.4° C. (35° F.) near the surface, such that the fluid emerges from the wellbore at a temperature of at least 32° C. (90° F.), just about the cloud point, whereas a temperature rise of 56° C. (100° F.) would be needed to melt the paraffin near the surface.

It has been both observed and calculated that a power dissipation of about three watts/meter (1 watt/ft) of tubing which is not thermally insulated produces a temperature rise of about 1° to 5° C. (2° to 8° F.), depending on the sizes of tubing 37 and casing 26, the rate of gas flow in the annulus 69, and the thermal properties of the adjacent overburden 23. The greater the flow rate, the thermal conductivity, or the thermal capacity of the overburden, the smaller the temperature rise. Choosing a value of 2.2° C. (4° F.) rise for three watts/m power dissipation as representative of casing sizes ranging from 4.5 inch (11.3 cm) to eight inches (20.3 cm) in diameter, the power requirements for various example systems presented in Table II.

TABLE II

Comparison of Input Power Requirement to Just Prevent Condensation or to Just Melt Paraffin for Five Different Heating Patterns and Methods

| Curve (From FIG. 2) | Heating Pattern and Method | Input Power to Just Prevent Condensation Watts | Input Power to Just Melt Paraffin Watts |
|---|---|---|---|
| 53A | Uniform Heating down to Casing Perforations 28 (60 Hz, short at 4000 ft., carbon steel) | 35,000 | 100,000 |
| 53 | Uniform Heating to Depth D, 2600 ft. (60 Hz, short at D, carbon steel) | 22,750 | 65,000 |
| 54 | Exponential Cosh Function (10 to 30 kHz, open circuit at 3200 ft., carbon steel) | 16,443 | 45,900 |
| 55 | Exponential Sinh Function (10 to 30 kHz, open circuit at 3200 ft., carbon steel) | 12,049 | 34,400 |
| 51 | Idealized Function | 11,380 | 32,500 |

Single phase loads drawn from a rural three phase line in excess of thirty kilowatts can adversely affect the power delivery system, especially if induction motors are used to pump the wells. Three phase induction motors can tolerate only a few percent variation between the individual phase-to-phase voltages. The most power efficient system heretofore proposed is that characterized by curve 53, or 53A, in an arrangement that requires in excess of sixty kilowatts for periodic melting of the condensible constituents such as paraffin. Table II makes apparent the improvements afforded by the systems of the present invention.

Other variations of spatial distribution can be realized in the heating system of FIG. 1, depending in major part upon the kind of termination used for the coaxial line heater afforded by casing 26 and tubing 37 in the space from the surface to depth D. Thus, by positioning an inductive choke 57 around tubing 37 as shown in FIGS. 3 and 4, at some level below depth D, a power dissipation distribution corresponding to curve 55 in FIG. 2 may be realized. Choke 57 may be formed by wrapping several layers of thin sheets of transformer steel around tubing 37. On the other hand, in utilizing a direct shunt such as electrical connector 48 (FIG. 1) at depth D, a spatial distribution for power dissipation like curve 56, FIG. 2, can be obtained if low-loss materials are used for casing 26 and tubing 37 and if the frequency f for the electrical power source 40 is selected so that the distance D is approximately one-half wavelength along the coaxial heater line 26,37.

The coaxial heating system of FIG. 1, comprising casing 26 and tubing 37, has operating characteristics corresponding generally to those of two coaxial metal cylinders having the dimensions shown in FIG. 5. In this coaxial line heater, the "skin depth" can be represented by the expression $$\delta\left[\frac{\omega\,\mu_c(H_r)\,\sigma_c}{2}\right]^{\frac{1}{2}},$$

in which:

$$H_r = \frac{I}{2\pi r},$$

the magnetic intensity at radius r, where I is the current in the tubing or casing and r is its radius, $\mu_c(H_r)$=permeability of a conductor in henries per meter, and $\sigma_c$=conductivity of the conductor.

For $r_o$, $r_i$, $b_o$ and $b_i$, in the following equations, see FIG. 5.

When $\delta << b_o$ and $b_i$, the high-frequency case, the resistivity R of the coaxial heater, in ohms per meter, is $$R = \frac{1}{2\pi}\left[\frac{R_{so}}{r_o} + \frac{R_{s1}}{r_i}\right]. \tag{2}$$

When $\delta >> b_o$ and/or $b_i$, for the low-frequency case or D.C., $$R = \frac{1}{2\pi\sigma_m}\left[\frac{1}{r_o\,b_o} + \frac{1}{r_i\,b_i}\right]. \tag{3}$$

In these equations (2) and (3), $R_{s0}$ is the resistive component of the surface impedance of tubing 37 and $R_{s1}$ is the resistive component of the surface impedance of the inside of casing 26. For ordinary 0.5% carbon steel tubing and casing, because $r_o > r_i$ and $R_{s0} < R_{s1}$, due to higher circumferential magnetic field intensities at the surface of the tubing, about 70% to 85% of the power (heat) is dissipated in tubing 37, the remainder being dissipated in casing 26. For equation (2) $R_s$ is the surface resistivity corresponding to $$R_s = \text{real part of}\left[\frac{\omega\,\mu_c(H_r)}{\sigma_c}\right]^{\frac{1}{2}}\underline{|\Phi(H_r)} \tag{4}$$

in ohms $$\underline{|\Phi(H_r)}$$

is the phase angle of the surface impedance as a function of $H_r$.

The characteristic impedance $Z_o$ of well 20, in ohms, is $$Z_o = \left[ \frac{R + j\omega L}{G + j\omega C} \right]^{\frac{1}{2}} \quad (5)$$

and its propagation constant δ is $$\gamma = \alpha + j\beta = [(R + j\omega L)(G + j\omega C)]^{\frac{1}{2}} \quad (6)$$

For equations (5) and (6), $$L = \frac{\mu_s}{2\pi} l_n (r_o/r_i) \quad (7)$$

plus the imaginary part of the expression in equation (4);

$$G = \frac{2\pi\sigma_s}{l_n (r_o/r_i)}; \quad (8)$$

and $$C = \frac{2\pi\epsilon_s}{l_n (r_o/r_i)}. \quad (9)$$

In expressions (7)–(9) $\sigma_{s1}$ $\mu_s$ and $\epsilon_s$ are the conductivity, permeability, and capacitance parameters for the space between tubes 26 and 37. $\alpha$ is the attenuation constant in nepers/meter and $\beta$ is the phase shift in radians/meter.

It can be shown that for low frequencies, $R >> \omega L$. For good insulation, $G << \omega C$. Further, so long as $f < 1$ megahertz, the attenuation $\alpha$ is roughly proportional to $\omega^{\frac{3}{4}}$.

The spatial distributions for heat dissipation illustrated in FIG. 2 by curves 54–56 are governed not only by the heating frequency f and the heater terminations, but also by the materials employed for casing 26 and tubing 37, especially the tubing. If highly conductive non-magnetic materials are employed, such as aluminum, the heating effect is minimal at lower frequencies and it becomes necessary to use much higher frequencies, into the MF band, to achieve sufficient power dissipation. The specific resistance of the tubing (and the casing) can be increased by utilizing stainless steel materials, which have high resistivities. The utilization of non-magnetic stainless steels will, of course, increase the rate of heat dissipation per unit length of tubing to an appropriate value, but their use is often uneconomical due to high cost.

The utilization of some ordinary carbon steels (e.g., 0.5% carbon steel) is quite attractive because the resistivity of these materials is roughly six times higher than for aluminum. As a consequence, the incremental losses along the coaxial power line constituting the heating apparatus are quite large in comparison with heat losses associated with the electrical power connections to the tubing and the casing and other such localized losses.

Figure 6:
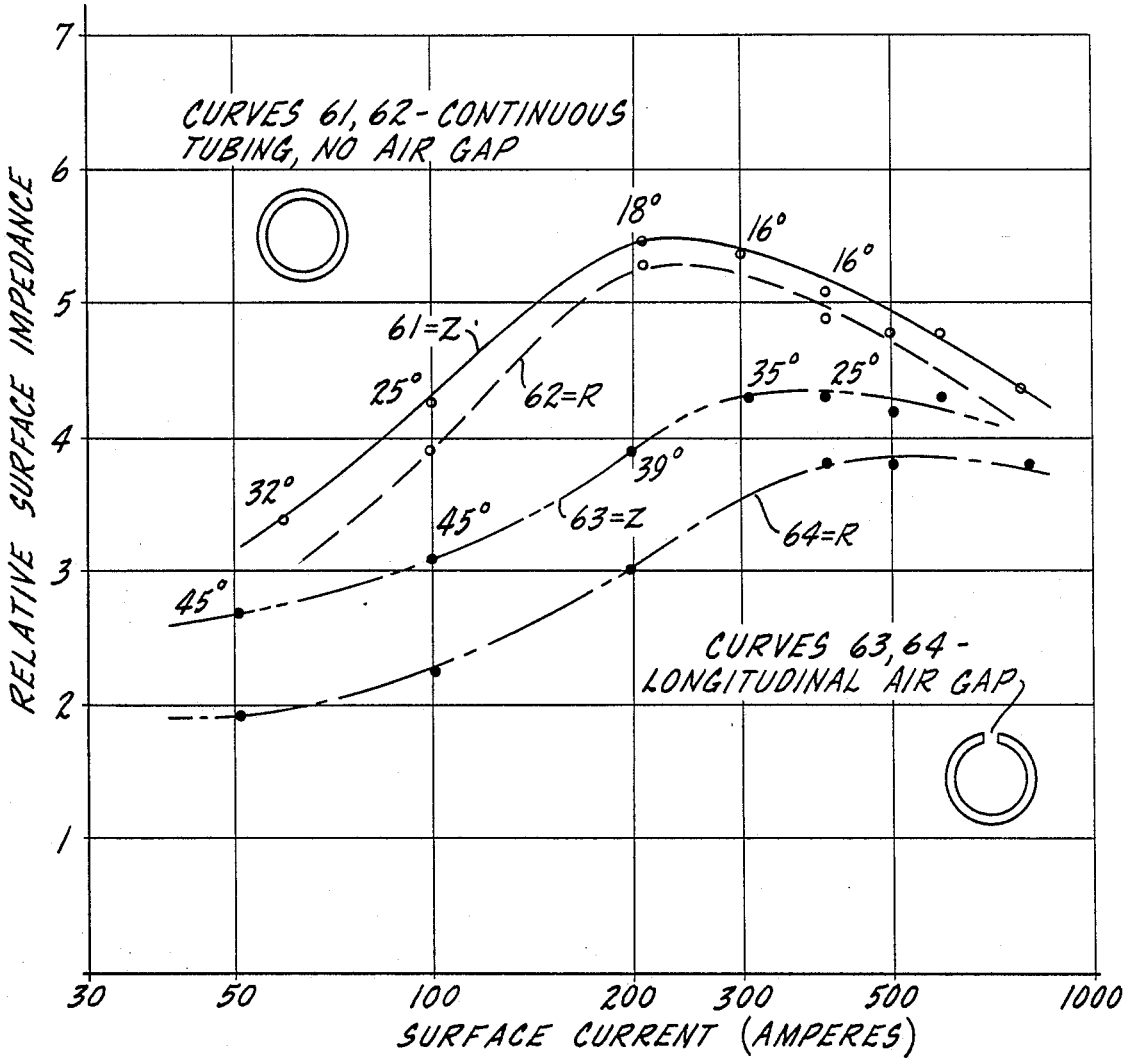
FIG. 6 is a chart of relative variations in surface impedance for carbon steel tubing.

Moreover, both the effective resistivity (usually stated in ohms per meter length) and the attenuation (nepers per meter) for conventional carbon steel tubing may be radically increased based on changes in permeability as a function of magnetic field intensity as well as resistivity increases achieved by use of higher power frequencies. The effect of changing permeability is illustrated by curves 61 and 62 in FIG. 6. Curve 61 represents total impedance in ohms per unit length, whereas curve 62 represents only the real (resistance) part of the impedance illustrated by curve 61. As seen from FIG. 6, the phase angle of the impedance changes appreciably over a range of sixty to eight hundred amperes and both the impedance and the resistance per unit length change markedly. In fact, the resistance of carbon steel tubing as stated in handbooks can be effectively increased by a large factor, of the order of three to ten times the resistance at low A.C. currents and conventional power frequencies, depending upon the effective permeability of the steel as a function of tubing current.

A number of authors give the effective permeability of machine steel or carbon steel as in a range from two hundred to four hundred. Under typical excitation conditions in a coaxial configuration of the sort afforded by the heating system of FIG. 1, however, the effective permeability can be very large, of the order of 3,000 to 4,000, because the magnetic flux is circumferential and is unimpeded by any air gap. In this configuration, with no air gap, even the 60 Hz effective resistance of the tubing may be as much as ten times that of the very low frequency or DC resistance of the carbon steel. That this is true is demonstrated by curves 63 and 64 in FIG. 6, which correspond to curves 61 and 62, respectively, except that a longitudinal air gap has been introduced into the tubing for curves 63 and 64. Note that in the continuous tubing with no air gap, curve 61, the phase angle varies from 32° at a low current to 16° for a high current. For the slotted tube, curve 63, the variation runs from 45° to about 25°. The increase provided by the unslotted conventional steel tubing is advantageous because it minimizes problems associated with connecting tubing 37 to casing 26 at some point in the well, as by connector 48 in FIG. 1. The same characteristic also minimizes the need for inconveniently large apparatus at the well surface, which would otherwise be required to handle what are likely to be very high currents.

Heat losses and other problems associated with effective connections between tubing 37 and casing 26 may, of course, be avoided by the use of a high frequency system which produces a heating pattern as illustrated by curve 54 in FIG. 2 without the necessity of a downhole electrical connection. This requires use of a relatively high frequency for power source 40. Such high frequency power sources are reasonably economical due to recent advances in electronic power technology and commercial equipment.

Nevertheless, the conventional power frequencies of 50 Hz and 60 Hz may be considered as economically attractive for many versions of the heating system of FIG. 1 because they do not require conversion to a higher frequency. They do have the disadvantage that a large power transformer is required. For these relatively low conventional power frequencies the optimum material for casing 26 and particularly for tubing 37 is a high permeability carbon steel which exhibits an enhanced effective permeability in dependence upon the current carried by the tubing, as illustrated by curves 61 and 62 in FIG. 6. This can best be understood in terms of some specific design data:

TABLE III

ELECTRICAL PARAMETERS OF COMMON METALS

| | Conductivity mhos/meter | Relative Permeability Minimum | Relative Permeability Maximum |
|---|---|---|---|
| Aluminum | $3.7 \times 10^7$ | 1 | 1 |
| 0.5% Carbon Steel | $6 \times 10^6$ | 200 | 3000 |
| Stainless Steel | $1.1 \times 10^6$ | 1 | 1 |
| 88× Steel | $1.3 \times 10^6$ | 1.01 | 1.95 |
| Cast Steel | $1 \times 10^7$ | 500 | 1250 |

TABLE III-continued

| ELECTRICAL PARAMETERS OF COMMON METALS | | | |
|---|---|---|---|
| | Conductivity | Relative Permeability | |
| | mhos/meter | Minimum | Maximum |
| Cast Iron | $1 \times 10^6$ | 200 | 350 |

Data from Attwood, Electric and Magnetic Fields, Power 1973 Electrical Materials Handbook, Allegheny-Ludlum, Pittsburgh 1961; Handbook of Chemistry and Physics Table III sets forth the conductivities for different tubing materials, including aluminum, conventional 0.5% carbon steel, stainless steel, and 88X steel, with cast steel and cast iron included for comparison purposes.

TABLE IV

DC AND AC RESISTANCE AND SKIN DEPTHS FOR A 4.5" O.D., 4.0" I.D. PIPE

| | DC Resistance | Skin Depth at 60 Hertz (meters) Relative Permeability | |
|---|---|---|---|
| | ohms/meter | Minimum | Maximum |
| Aluminum | $1.3 \times 10^{-5}$ | $1.2 \times 10^{-2}$ | $1.2 \times 10^{-2}$ |
| 0.5% Carbon Steel | $7.9 \times 10^{-5}$ | $2.1 \times 10^{-3}$ | $5.4 \times 10^{-4}$ |
| Stainless Steel | $4.3 \times 10^{-4}$ | $7.2 \times 10^{-2}$ | $7.2 \times 10^{-2}$ |
| | AC Resistance, 60 Hz, ohms/meter Relative Permeability | | |
| | Minimum | Maximum | |
| Aluminum | $1.3 \times 10^{-5}$ | $1.3 \times 10^{-5}$ | |
| 0.5% Carbon Steel | $2.3 \times 10^{-4}$ | $9.2 \times 10^{-4}$ | |
| Stainless Steel | $4.3 \times 10^{-4}$ | $4.3 \times 10^{-4}$ | |

Table IV presents the resistance values and skin depths for some of the metals of Table III, specifically for a casing having an outer diameter of four and one-half inches and an inside diameter of four inches. The 0.5% carbon steel impedance varies over a range of four to one due to the variation in the effective permeability caused by the circumferential magnetization associated with current flowing longitudinally of the tubing. Such an enhancement of impedance (and resistance), resulting from increased effective permeability of the carbon steel tubing, simplifies the system design for the heating apparatus of FIG. 1 and leads to a more reliable operation than with other tubing materials.

The electrical contacts afforded by connectors 47 and 48 (FIG. 1) can be critical to operation of the heating system. In previously known downhole electrical heating systems, utilizing comparable electrical interconnections from production tubing to well casing, sliding contact "centralizer" devices are often employed. They are quite unsatisfactory, however. Over a substantial period of time, they tend to develop appreciable contact impedance and resistance. Typically, the electrical contact is made only at tiny points on the surfaces of the sliding contact element and the casing. This leads to excessive heat loss at the points of contact and also results in corrosion that is accelerated due to the elevated temperatures in the well. With continued operation, the heat dissipation increases, corrosion is further accelerated, and the electrical contact degrades, frequently to inoperability.

To overcome this problem, a molecular bond-type anchor should be employed for these connectors, particularly connector 48. In such an anchor sharp metal ridges on an electrical connector or contactor are forced into the casing, so that the imprint of the ridges can be seen if the connector is removed. Any surface corrosion is removed by the initial penetration of the casing by the sharp metal ridges on the connector. Those ridges make continuous and uniform contact wherever the surface of the casing metal is penetrated by more than a few microinches. This forms what may be called a molecular bond, with an impedance preferably less than a milliohm; this type of contact is stable over long periods of time.

As a further specific example of a heating system of the kind illustrated in FIG. 1, consideration may be given to a well in which depth D is 600 meters, tubing 37 is uniformly heated by 60 Hz current, the tubing being terminated by a short to casing 26 (e.g., connector 48). This arrangement requires an energy input of fifty watts per meter (15 watts/ft.) to preclude paraffin condensation. The pertinent parameters for different tubing materials, including aluminum, 0.5% carbon steel, and stainless steel, are set forth in Table V, for which ordinary sliding contact resistance is taken as approximately $10^{-2}$ ohms; the preferred molecular bond contact resistance is taken as $10^{-3}$ ohms, and total heat dissipation is taken as the sum of the tubing, contact and miscellaneous power losses.

TABLE V

DESIGN EXAMPLE, TUBING CURRENT AND BOND DISSIPATION 50 W/m HEAT RATE, f = 60 Hz 600 METER DEPTH

| | Tubing Current (Amperes) | Tubing Dissipation (kW) | Sliding Contact Power Loss (watts) | Molecular Bond Power Loss (watts) |
|---|---|---|---|---|
| Aluminum | 1,970 | 30 | 38,809 | 3,881 |
| Carbon Steel DC | 1,025 | 30 | 10,504 | 1,050 |
| Carbon Steel AC | 463–233 | 30 | 543–2,143 | 54–214 |
| Stainless Steel | 339 | 30 | 1,154 | 115 |

For the aluminum tubing, the dissipation requirement using either a sliding contact or a molecular bond contact is excessive. A similar situation exists if a very low frequency (e.g.,DC) is chosen for the carbon steel, with the sliding contact exhibiting over ten kilowatts of dissipation. Over the few feet of the contact region in which this occurs, this is an excessive heat dissipation that will result in undue temperature increases in a limited region.

If AC heating is utilized, at a frequency normally employed for power distribution, 50 or 60 Hz, the heat dissipation in the molecular bond contact is quite acceptable for the carbon steel, being in a range of 54 to 214 watts. The sliding contact dissipation for carbon steel still ranges between 500 and 2000 watts, which could produce excessive heating and degradation by corrosion. For the stainless steel, as shown in Table V, the molecular bond contact affords an acceptable dissipation level whereas the sliding contact is marginal.

The complexity of the aboveground equipment for a well heating system like that of FIG. 1 is partly a function of the current requirements and partly a function of the total power requirements. In the case of aluminum tubing heated either by AC or DC, or a carbon steel tubing heated by DC, the required currents (Table V) are in excess of 1000 amperes. This complicates the design of the aboveground equipment and materially increases its cost. When the carbon steel excitation is carried out at 60 Hz, the current requirements are markedly reduced to a range of 233 to 463 amperes. Similar values apply to the stainless steel tubing, regardless of whether AC or DC excitation is employed. Thus, from Table V it is apparent that the aboveground electrical equipment, particularly power source 40 and control 44, are far less complicated for AC-energized carbon steel tubing and for stainless steel tubing than is the case with aluminum or with carbon steel energized by direct current. However, the carbon steel is far less expensive than stainless steel. Thus, from the standpoint of both economics and performance, carbon steel, with a variable and complex permeability, is the optimum material for use in well 20, particularly for production tubing 37. This material exhibits a variable impedance as a function of the current carried by the tubing, at least up to a current of about 190 amperes.

The heating system of FIG. 1 may be further simplified and reduced in cost by two other expedients that may be utilized individually or jointly. Thus, tests have indicated that a bare production tubing 37 may require approximately twenty-five to fifty watts per meter heat dissipation to effect a temperature rise of about 33° to 40° C. (60°–70° F.) as needed to preclude paraffin condensation in a rather typical well situation. If tubing 37 is thermally insulated, however, as by the thermal insulator sleeve 59 shown in FIG. 1, the heating requirement may be reduced to a level of about fifteen to twenty plus watts per meter.

For discussion purposes, it may be assumed that approximately thirty kilowatts of heating are required by a given well and that the readily available power frequency is 60 Hz. To supply this power at a high current level, a low voltage high current 60 Hz power transformer is required. In this arrangement, control 44 may be an ON/OFF semiconductor controller acting in response to one of several input control signals as discussed hereinafter. The overall weight of a power supply and control of this kind, particularly due to the transformer requirements, is likely to exceed 500 pounds. Furthermore, the cost is substantial, particularly due to the size, weight, and installation requirements.

If the operating frequency f is materially increased, however, the resistance of the carbon steel tubing employed as production tubing 37 is materially increased. For typical tubing and casing sizes, this relationship may be expressed as:

$$R \cong R_{60}\sqrt{\frac{f}{60}} \tag{10}$$

where $R_{60}$ is the resistance at 60 Hz, f is the increased frequency, and R is the resistance at the increased frequency. Thus, with an adequate increase in the operating frequency f the resistance of the tubing can be increased to an extent such that a transformer is no longer needed to match the characteristics of source 40 and control 44 with those of the coaxial heating line comprising tubing tubing 37 and casing 26.

Transformerless designs of frequency changers are commercially available and are particularly attractive because the electronics employed are roughly comparable to those utilized in a conventional ON/OFF semiconductor controller whereas the cost and weight and the related installation cost for the conventional 60 Hz transformer is eliminated. In some instances, for safety reasons, a transformer may be required, but at the higher frequency the weight and cost of the transformer are appreciably reduced as compared to a conventional power frequency.

Control of energization of the coaxial heating apparatus 26,37 (FIG. 1) can be based upon several different parameters, but the best basis for control is probably the exit temperature for liquids leaving well 20. Thus, a thermocouple or other thermal sensor 65 may be mounted in the liquid output conduit 34, preferably ahead of valve 35 so that it senses the temperature of the liquid output of well 20 before there is any appreciable cooling due to the liquid leaving the well. By monitoring the temperature with thermocouple 65, whether located as shown in wellhead 36 or at some depth below the wellhead, power control circuit 44 can be made to maintain the temperature in the heated portion of well 20 at a level such that no paraffin will precipitate in tubing 37. To avoid excessive energy costs and waste, and to avoid other deleterious effects of overheating, moreover, control circuit 44 should also be set to shut off heating whenever the output temperature rises excessively. That is, the temperature range maintained by the coaxial heating system 26, 37 and its electrical energizing circuits 40 and 44, based on the input from sensor 65, should be between the melting temperatures for the paraffins or other condensible constituents in the well output and the condensation temperature for those same constituents in the fluid from the well. This may require some preliminary experimentation, since each well will likely vary from any others, but can be established without undue difficulty. Continuous temperature-based control can be maintained by continuously varying the power supplied to the heating system.

It is preferable for control circuit 44 to maintain the temperature throughout the heated zone in tubing 37 of well 20, from surface 22 to depth D, closer to the condensation temperature than to the melting temperature of the condensible constituents, in order to optimize the heating system from the standpoint of economical and efficient use of the electrical energy from source 40. Too low a temperature setting for power control circuit 44, however, such that some accumulation of paraffin or other condensible constituents is permitted in tubing 37, is self-defeating. Too high a temperature, of course, is economically wasteful. There is usually a substantial spread, of the order of 30° C., between the condensation temperature and the melting temperature for the condensible constituents, so that, as previously noted, adjustment of power control circuit 44 is not unduly difficult.

Another useful control parameter is the rate of flow of liquid from the output conduit 34. Thus, a flow rate sensor 66 may be incorporated in line 34 (FIG. 1) and an appropriate signal from that sensor may be supplied as a control input to circuit 44. Assuming that sensor 66 can detect the effect of small accumulations of paraffin (or other condensible constituents) in tubing 37, its signal output can be employed to continuously control the power delivered through control circuit 44 to tubes 26,37 to optimize heater efficiency. For example, this arrangement can hold the temperature of the fluid near the cloud point and thus substantially below the melting point. By use of a memory system as part of the overall control, the temperature of tubing 37 may be allowed to drop periodically for re-determination of the temperature at which the output flow rate (or pump power utilization rate) is noticeably affected. Apart from such intermittent test periods, the temperature of tubing 37 is held a few degrees above the temperature at which an appreciable effect is sensed. Alternatively, flow rate sensor 66 may be employed as a backup or emergency control in a system using a thermal sensor (e.g. 65) for the primary control input.

Another basis for actuation of power control circuit 44 may be an input signal derived from the pump mechanism that drives pump rod 39 or from the pump rod itself. Thus, a strain gauge may be mounted on pump rod 39 or a power input signal may be derived from the pump mechanism that drives that rod. Again, these are control indications that may provide information, for example, regarding accumulations of paraffin just beginning to form in tubing 37. These signals can be used for continuous control, either continuous or with memory as discussed for the flow sensor, or may be used as a backup control for circuit 44 and the overall heating system. The preferred control is predicated upon thermal sensor 65 or a similar sensor positioned in the fluid output portion of well 20 or somewhere within tubing 37 above depth D.

Figure 7A:
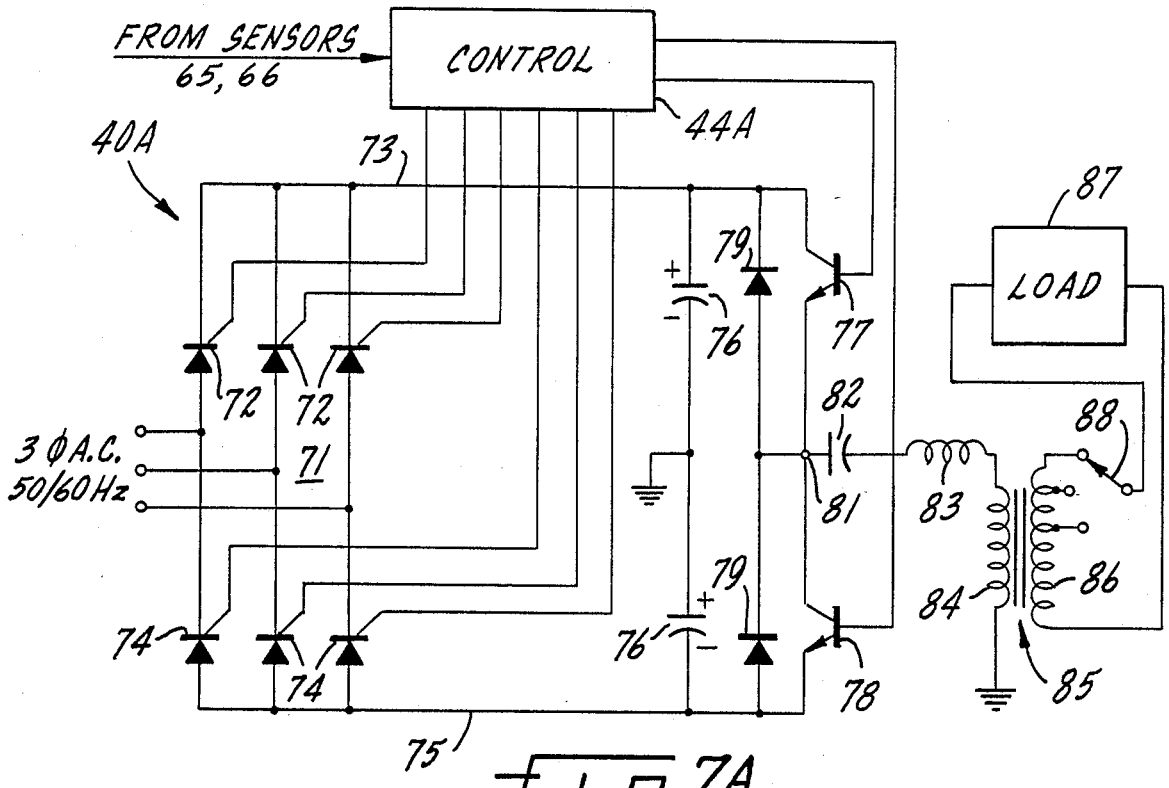
FIGS. 7A and 7B are schematic diagrams of electrical power sources for use in the heating system of FIG. 1.

FIG. 7 illustrates a controllable electrical frequency-changer power source 40A that may be utilized as the power source 40 (FIG. 1) in a system requiring an increased operating frequency f. Power source 40A is supplied from a conventional three phase A.C. 50/60 Hz supply, such as a rural power line or an engine-generator set. It includes a balanced rectifier circuit 71 including three thyristors 72 connecting the individual input lines to a positive polarity bus 73 and another set of thyristors 74 connecting the input lines to a negative bus 75. The gate electrodes of all of the thyristors 72 and 74 are connected to a control circuit 44A.

A pair of capacitors 76 are connected in series with each other across buses 73 and 75, with the terminal between the capacitors grounded. A pair of switching transistors 77 and 78 are also connected in series between buses 73 and 74, each in parallel with a diode 79. Transistors 77,78 are also connected to control 44A. The common terminal 81 between transistors 77 and 78 is connected to a series resonant circuit comprising a capacitor 82, an inductor 83, and the primary winding 84 of a transformer 85, winding 84 being returned to ground. The secondary winding 86 of transformer 85 is connected to a load 87, which would include the upper portion of tubing 37 and casing 26 in the system of FIG. 1. Secondary 86 may be provided with appropriate voltage adjustment taps as indicated at 88.

Thyristors 72 and 74 are controlled by gating waveforms generated by control 44A in response to the power needs of the heating system, as signalled to control 44A by sensors 65,66, etc. Varying the timing of the gate (conduction) angles of the thyristors varies the charge on capacitors 76 and thus varies the voltage between conductors 73 and 75. Full-on or full-off switching devices, such as the transistor-diode combinations shown at 77 and 78, are driven so that when transistor 77 is on transistor 78 is off, and vice versa. This action produces a high frequency square-wave which is applied to transformer 85 via the circuit 82–84, which is resonant at the fundamental frequency of the square-wave. The fundamental sinusoidal component of the square-wave is applied, via transformer secondary 86 and tap selector 88, to load 87.

The power dissipated in load 87 can be continuously controlled by varying the conduction angles of thyristors 72 and 74, which in turn controls the amplitude of the applied voltage and hence the power supplied to the load. Alternatively, the average power can be controlled by a bang-bang action, with thyristors 72 and 74 turned full-on whenever the temperature of the well output drops below a prescribed limit and then turned full-off whenever the temperature exceeds a preselected upper limit.

Figure 7B:
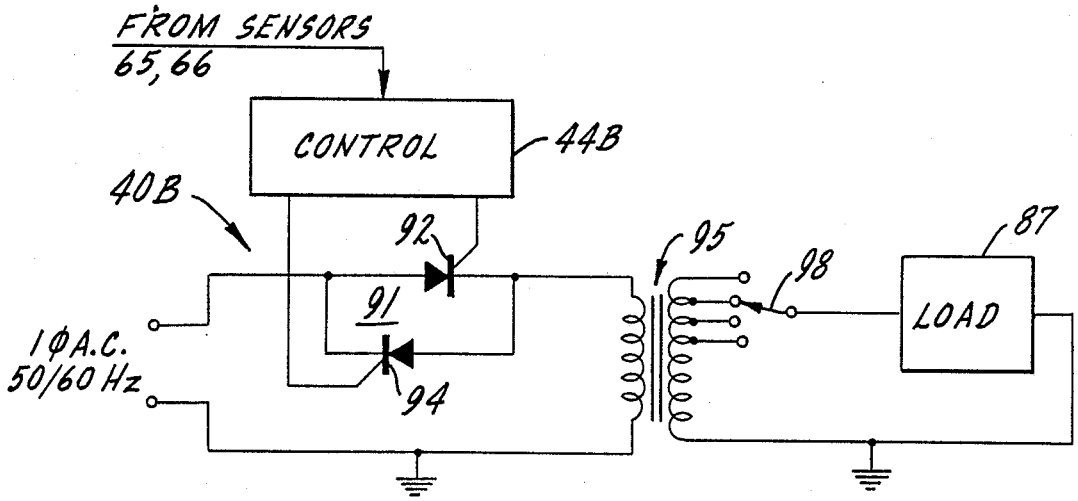

Similar techniques are available to control 50/60 Hz applied power. FIG. 7B illustrates a power source 40B wherein the applied power from a single-phase 50/60 Hz supply is varied continuously by changing the conduction angle of two thyristors 92 and 94 in a rectifier 91, using a gate control circuit 44B; an alternative bang-bang control technique, with thyristors 92 and 94 gated full-on for a period of time and then gated full-off for a similar interval in response to changes in system heating requirements is also possible. In FIG. 7B thyristors 92 and 94 are connected to the primary of a power transformer 95; the tapped secondary 96 of transformer 95 supplies power to load 87.

In some wells, as previously noted, there may be surrounding formations such as aquifer 49 (FIG. 1) that have high thermal losses. To compensate for situations of this kind, individual segments such as a segment 37C of higher resistance may be included in tubing 37; see FIG. 1. In many instances, however, this will not be necessary, particularly if a thermal insulator sleeve 59 is utilized on the production tubing, and especially in regions of high thermal loss.

For some production conditions, the cloud point temperature may not be the lowest temperature at which tubing 37 may be held while maintaining reliable and economical well operation. The surface conditions of the tubing and the flow rate, in combination, may effectively preclude substantial deposition until the temperature falls to a level substantially below the cloud point. This temperature, the "flow impairment point", is observed by noting the long-term tubing temperature below which the design ratings of the pumping system (rods, pump, motor) must be exceeded to maintain operation.

In relatively shallow wells or other mineral wells with relatively high concentrations of paraffins, the reservoir temperature may be very close to the cloud point for the petroleum. In such wells, paraffin precipitation may commence as the fluid approaches the perforations 28 from the reservoir 24, due to release of gases from the fluid near the wellbore and the resultant decrease in paraffin solubility, or due to decrease in temperature of the fluid in the wellbore region as the gases escape and expand and the resultant cooling of the fluid below its cloud point. Paraffin precipitation under such conditions can plug the pore spaces within the reservoir matrix, or the perforations 28, or the intake of pump 38. Paraffin will also continue to condense inside tubing 37 as the fluid cools in its movement upwards toward the surface if the tubing is not properly heated.

The extent of paraffin plugging in such wells depends on a number of factors, including the depth of reservoir 24 below surface 22, the temperature of the reservoir, the composition of the produced fluids, and thermal properties of the fluids. Production of a substantial quantity of gas along with every barrel of petroleum is common for mineral wells producing light petroleum. A significant portion of this fluid evaporates in the reservoir surrounding the wellbore, to a radial extent of about six to ten feet (two to three meters). Such evaporation decreases the API number of the petroleum by two to three units. For example, consider a mineral well producing light petroleum with an API of 39° inside the reservoir, and a paraffin content of 4.5%, which is close to its solubility limit. A drop in the API to 37° as the fluid approaches the casing perforations 28 will decrease the solubility of paraffins to 3.5%. Under conventional operation of the well, this results in precipitation of about 130 lbs. of paraffin per day for a well producing about forty barrels of fluid daily. Such an accumulation decreases productivity appreciably within a few days. The paraffin accumulation problem is further aggravated by cooling of the fluids in reservoir 24 due to evaporation of the volatiles and expansion of the gases. The fluid temperature can drop by two to three degrees, and this can also cause precipitation of paraffin in the wellbore region, particularly for a shallow mineral well producing petroleum containing a relatively high concentration of paraffins, in which the reservoir temperature is approximately the same as the cloud point temperature.

In such wells it is important to heat both the reservoir and the tubing to effectively mitigate paraffin accumulation problems. Heating tubing 37 alone is not adequate. Localized heating of the wellbore region is also insufficient by itself, because the fluids moving upwardly through tubing 37 cannot carry enough heat to compensate for the heat losses to overburden 23 and hence cannot mitigate paraffin accumulation inside the tubing. It is necessary to distribute the power applied in an optimum manner between tubing 37 and the reservoir 24 surrounding the wellbore to preclude paraffin accumulation in such wells. Similar problems are also presented in sour gas wells, due to condensation of sulfur from cooling of sulfur-laden gases.

For mineral wells that require heating of both tubing 37 and the wellbore reservoir, the spatial distribution of power dissipation should be adjusted to provide optimum distribution between both tubing and the wellbore region. FIG. 8 illustrates one configuration of the present invention that heats both tubing 37 and the part of reservoir 24 in the wellbore region. Aboveground electrical connections to the tubing and casing may be as described for FIG. 1. An insulated section 33A similar to insulator stub 33 is provided in casing 26 just above reservoir 24. Insulator casing section 33A electrically isolates the upper conductive portion 26A of the casing present in overburden 23 from the next lower portion 26B in reservoir 24. Electrical connector 48 is placed below casing insulator section 33A to electrically connect production tubing 37 to the lower, perforated portion 26B of conductive casing 26. Another electrical insulator segment 33B may be used in the casing below deposit 24. Casing sections 33A and 33B can be short lengths of non-conducting pipe made of materials such as fiberglass. An insulator tube 59A is mounted on tubing 37, extending from connector 48 up above level 29.

For a well producing about forty barrels of petroleum per day, and having a total depth of 1000 meters, the steady-state power requirements for the part of the heating system aligned with reservoir 24 are likely to be of the order of three to seven kilowatts. As explained in the preceeding pages, heat requirements for tubing 37 are of the order of ten to thirty kilowatts. Thus, the heat requirements in the producing zone, deposit 24, are a minor portion of the total heat requirements. The heating system for such an embodiment of the present invention is still a coaxial heating system as described above, but with an exposed electrode 26B in the deposit. Current flows from this electrode via the deposit back to the upper casing 26A, which still acts as a return circuit. The frequency and other system parameters, such as materials used for the production tubing, should still be selected so that a major portion of the power is dissipated within the coaxial heating element 26,37 above depth D, and only a minor portion is dissipated in reservoir 24.

FIG. 9 exemplifies an adaptation of the heating system described in FIG. 8 to the open hole completion methods practiced in certain reservoirs in California and elsewhere. A gravel pack 98 around a conductive screen 99 may be used in these reservoirs to prevent unconsolidated sand from flowing into the pump and the well. The electrical contact is made between the conductive screen 99 (and also the exposed pump 38) and the uninsulated tubing system to the sand via the reservoir fluids, then to the deposit and to the casing. This is adequate to provide the heating necessary in the region of deposit 24 adjacent the wellbore. An electrical connector 48 (FIG. 8) is not required for high conductivity reservoir fluids. Electrical insulator sleeves 100 and 101 electrically isolate the top and bottom portions of the screen from the deposit. In this arrangement, the return circuit may still be through casing 26.

The required division between power dissipated in the deposit and power used to heat tubing 37, in the heating systems of this invention, can be achieved by proper selection of the tubing materials, by choice of an appropriate spatial distribution of different tubing materials, by selection of the geometry of the tubing and the casing, and by choice of the heating frequency f. These are selected based on the "spreading" resistance of deposit 24, which is in the order of 0.3 to 3 ohms and which is largely independent of frequency, up to about one MHz. Power dissipation is proportional to the resistive losses in the tubing and in the spreading resistance. The effective resistance of tubing 37 (and hence its losses), can be increased relative to the spreading resistance by increasing the frequency f which, in turn, increases the hysteresis, eddy-current, and skin-effect losses in tubing 37 as previously discussed. The spatial distribution of heat dissipation in tubing 37 can also be adjusted to the well requirements by interleaving low loss segments of materials such as aluminum with segments fabricated from higher loss materials such as 0.5% carbon steel.

Other options are also possible. For example, it is possible to combine two types of power sources, such as a radio-frequency source of a frequency f and a second source operating at a much lower frequency (e.g., 60 Hz down to D.C.). Because of the loss characteristics of the tubing, the RF energy will be absorbed only in the upper parts of the well whereas the low frequency energy is principally absorbed in the spreading resistance in the deposit.

Somewhat different problems occur in the production of heavy crude oils found in many localities. These difficulties are similar to those encountered in production of paraffin-based oils, except that the problem is to lower the viscosity rather than to maintain a temperature which prevents the precipitation of wax. Heat lowers the viscosity of the heavy crudes and often results in improved production rates. The previously discussed methods of heating both the tubing and the deposit are also applicable to enhancing the flow rate of heavy oils into the wellbore as well as reducing the pumping costs due to the very high viscosity of the oil in the production tubing.

As opposed to the paraffin situation, these heavy oils do not precipitate a coagulant such as paraffin; the viscosity varies smoothly but quite rapidly as a function of temperature. Typically, for many oils the viscosity changes an order of magnitude for every 10° to 15° C. change in temperature.

When the oil is cold and quite viscous, the energy losses due to viscous flow dominate. The pumping power required is roughly proportional to the viscosity. In the case of horse-head pumping systems, the high viscosity of the fluids impedes pump rod movement, slowing its rate of drop due to gravity. This may radically reduce the flow rate. As the temperature of the viscous fluids in the tubing is increased and viscosity is reduced, energy losses are dramatically reduced, to a point at which other losses in the system become important. The pump rod can drop rapidly, so that a full pumping rate is realized. On the other hand, as the temperature of the tubing is increased, the electrical energy requirements are also similarly increased. Thus, a point is reached at which the tubing temperature is so high that the increased energy costs to heat it further are no longer offset by any decrease in pumping power costs or increase in pumping rate. Thus, a broad optimum exists, with the tubing heated enough so that pumping power costs are reasonable and adequate flow rates are realized, but not enough to require excessively high amounts of heating energy. The lowest tubing temperature for a viscous oil may be taken as the temperature below which the oil exhibits a viscosity that requires some system component (e.g., pump, pump motor) to exceed its design rating to a substantial extent or the pump rod fails to drop quickly. This may be termed the "flow impairment" temperature.

For a specific well and pump design, the decrease in pumping power costs and the increase in production rates can be experimentally measured and compared with the increased power consumption required for increasing the temperature of the tubing. This comparison can be done manually, or preferably by a control similar to the power control circuit 44 previously described for paraffin-prone wells. Once the desired heating rate is ascertained it can be continuously controlled or intermittently re-tested as previously discussed.

The electrical heating systems of the invention are also applicable to certain our gas wells. In such wells, as gas is produced sulfur is condensed and forms along the production tubing. This is particularly troublesome when the condensed deposits of sulfur contain hydrogen and other compounds at supercritical pressures and temperatures. During operation of such wells sulfur is readily precipitated if the temperature of the tubing falls below the melting point of the sulfur, 215° F. (102° C.). Above 215° F., the viscosity of such fluids remains relatively small, but increases abruptly as the temperature increases over 300° F. (149° C.). Thus, an optimum range of temperature exists for the supercritical deposits of sulfur and hydrates between 220° and 300° F. (102°–149° C.).

The heating system is also appropriate to minimize the deposits of hydrate crystals in the flow lines of high pressure gas wells. Such crystals can form upon a decrease in temperature, given a combination of water and hydrocarbon vapors, possibly coupled with a change in pressure. Such deposits might well occur around the wellbore or perhaps at some cooler portions of the production tubing. Each well must be studied to determine the best spatial distribution of the heating pattern.

From the foregoing description it will be apparent that in any mineral well in which the heating system of the present invention is to be used, there is a flow impairment temperature above which the mineral fluid flowing through tubing 37 above depth D should be maintained in order to avoid a reduction in flow rate for the well. For wells tapping paraffin-prone petroleum deposits, perhaps the kind of wells in which the heating system will be most frequently employed, this flow impairment temperature normally constitutes the cloud point temperature for the paraffins in the oil. As previously noted, though, surface conditions of the tubing, in combination with the flow rate of the well, may produce a well in which the flow impairment temperature is appreciably lower than the cloud point. Other mineral fluids may include constituents subject to condensation or coagulation; for such fluids, the flow impairment temperature is that temperature at which appreciable condensation, precipitation, or coagulation is initiated, sufficient ultimately to impair the well operation. In wells pumping viscous oils, the flow impairment temperature is that temperature level below which the viscosity of the oil requires some part of the system, such as the pump or the pump motor, to exceed its design rating to an appreciable extent. In sour gas wells, the flow impairment temperature is that at which some form of sulfur is readily precipitated, usually about 220° F. (105° C.). For mineral fluids containing components that form hydrate crystals, there is also a determinable flow impairment temperature, dependent upon the operating pressure of the well and other related factors.

Of almost equal importance, in any mineral fluid well in which the heating system is to be employed, care should be exercised to avoid overheating of the well, particularly in the portion of the well above the subsurface level D. For oils containing paraffin as the primary condensible constituent, this upper limit temperature is the melting temperature for the paraffin. This is essentially true also with respect to petroleum and other mineral fluids containing different condensible constituents that behave in a manner similar to paraffin. For viscous oils, the upper limit temperature is the five centipoise temperature level. In sour gas wells, the upper limit temperature for the optimum range is that at which the viscosity of the fluid increases, generally about 300° F. (149° C.). In any of the heating systems of the present invention, the basic criterion for the upper temperature limit is that temperature beyond which additional heating is economically wasteful and, for at least some fluids, may lead to overly rapid deterioration of well operation.

We claim:

1. A well heating system for a mineral well of the kind in which a flow of a mineral fluid moving upwardly above a predetermined subsurface depth D is subject to impairment due to condensation of paraffin or other condensible constituents from the fluid flow or to increasing viscosity of that fluid, caused by temperature reduction, the well comprising a well bore projecting downwardly from a surface to a fluid reservoir and having an outer wall that is electrically conductive, and an electrically conductive production tubing extending down into the well bore in physically spaced and electrically insulated relation to the well bore wall, the heating system comprising:

an electrical power source;

connection means for electrically connecting the power source to the tubing and to the electrically conductive wall so that the tubing and wall conjointly afford a two-conductor heating apparatus projecting downwardly into the well bore, which heating apparatus functions electrically approximately as a coaxial line;

means for effectively terminating the coaxial line so that most of the electrical power supplied to the coaxial line from the power source is dissipated within the well above the depth D;

and control means for controlling the electrical power supplied to the coaxial line from the power source to maintain the mineral fluid flowing in the tubing approximately at or above a flow impairment temperature for the fluid without substantially exceeding a predetermined upper limit temperature for the fluid in more than a minor fractional part of the well from depth D to the surface, in which the temperature limits are:

| content of mineral fluid | flow impairment temperature | upper limit temperature |
|---|---|---|
| paraffin | cloud point | paraffin melting point |
| sulfur | sulfur precipitation point | 300° F. |
| hydrates | crystal precipitation point | 300° F. |
| heavy, viscous oil | no-flow pour point | five centipoise temperature |

2. A mineral well heating system according to claim 1 and further comprising a thermal insulator sleeve encompassing at least a portion of the production tubing above the depth D.

3. A mineral well heating system according to claim 2 in which the thermal insulator sleeve encompasses substantially the entire length of the production tubing above the depth D.

4. A mineral well heating system according to claim 1 in which the electrically conductive wall of the well bore comprises a cylindrical metal casing.

5. A mineral well heating system according to claim 4 and further comprising a thermal insulator sleeve encompassing at least a portion of the production tubing above the depth D.

6. A mineral well heating system according to claim 1, in a mineral well in which the overburden surrounding the well bore above the depth D includes at least one lossy formation which exhibits a significantly higher heat loss from the heated tubing than adjacent formations;

in which the production tubing includes a section having a high heating rate;

and in which the production tubing section of high heating rate is aligned with the lossy formation to afford concentrated heating at the depth of the lossy formation.

7. A mineral well heating system according to claim 6 and further comprising a thermal insulator sleeve encompassing at least a portion of the tubing above the depth D, that portion being aligned with the lossy formation.

8. A mineral well heating system according to claim 1 in which the rate of heat dissipation varies as an inverse function of depth, downwardly along the production tubing from the surface to the depth D.

9. A mineral well heating system according to claim 8 and further comprising a thermal insulator sleeve encompassing at least a portion of the production tubing above the depth D.

10. A mineral well heating system according to claim 4 in which the means for terminating the coaxial line is an electrical connector positioned approximately at the depth D and affording a molecular bond with both the well casing and the production tubing.

11. A mineral well heating system according to claim 10, and further comprising a thermal insulator sleeve encompassing at least a portion of the production tubing above the depth D.

12. A mineral well heating system according to claim 1 in which the means for terminating the coaxial line is an electrical open circuit in the production tubing.

13. A mineral well heating system according to claim 12 in which the open circuit is formed by a series-connected section of electrically non-conductive tubing interposed in the production tubing.

14. A mineral well heating system according to claim 12 in which the power source is an alternating current source and the open circuit is formed by a series inductive reactance.

15. A mineral well heating system according to claim 12 in which the open circuit is positioned at a depth substantially below the depth D.

16. A mineral well heating system according to claim 15 and further comprising a thermal insulator sleeve encompassing at least a portion of the production tubing above the depth D.

17. A mineral well heating system according to claim 1 in which the production tubing comprises magnetic steel tubing and in which the power source is an alternating current source having a frequency f in the range of 50 Hz to 500 KHz.

18. A mineral well heating system according to claim 17 in which at least the major portion of the production tubing above depth D is carbon steel tubing.

19. A mineral well heating system according to claim 18 and further comprising a thermal insulator sleeve encompassing at least a portion of the production tubing above the depth D.

20. A mineral well heating system according to claim 18 in which the the frequency f of the power source exceeds 300 Hz.

21. A mineral well heating system according to claim 17 in which the A.C. impedance of the production tubing at the frequency f is at least three times the D.C. impedance.

22. A mineral well heating system according to claim 17 in which the ratio of the applied voltage to the input current, for the coaxial line, varies by at least ten percent for an input current range of ten to five hundred amperes.

23. A mineral well heating system according to claim 17 in which the phase angle between the applied voltage and the input current, for the coaxial line, is in a range of 5° to 45°.

24. A mineral well heating system according to claim 23 in which the phase angle between the applied voltage and the input current, for the coaxial line, decreases by at least 5° as the tubing current is increased from ten to five hundred amperes.

25. A mineral well heating system according to claim 21 in which at least the major portion of the production tubing above depth D is carbon steel tubing.

26. A mineral well heating system according to claim 22 in which at least the major portion of the production tubing above depth D is carbon steel tubing.

27. A mineral well heating system according to claim 23 in which at least the major portion of the production tubing above depth D is carbon steel tubing.

28. A mineral well heating system according to claim 1 in which the power source is an alternating current source having a frequency f and a waveform such that the input impedance of the coaxial line is high enough to permit use of a transformerless power source.

29. A mineral well heating system according to claim 1 in which the power source is a switching type alternating current power source having a frequency f in the range of 300 Hz to 500 kHz.

30. A mineral well heating system according to claim 1 in which the control means includes thermal sensor means for sensing the temperature of fluid flow from the production tubing and means for varying the current from the power source to the coaxial line to maintain that temperature substantially constant.

31. A mineral well heating system according to claim 30 and further comprising a thermal insulator sleeve encompassing at least a portion of the production tubing above the depth D.

32. A mineral well heating system according to claim 30 in which the thermal sensor is positioned in a fluid outlet connected to the production tubing above the surface.

33. A mineral well heating system according to claim 30 in which the thermal sensor is positioned in a casing cap comprising an extension of the well wall above the surface.

34. A mineral well heating system according to claim 30 in which the thermal sensor is positioned within the production tubing above the depth D.

35. A mineral well heating system according to claim 1 in which the control means includes means for sensing the rate of fluid flow in the production tubing and means for increasing the current from the power source to the coaxial line in response to sensing of a fluid flow rate below a given rate indicative of flow impairment.

36. A mineral well heating system according to claim 1 for a well including a pump for pumping mineral fluid up through the production tubing, in which the control means includes means for sensing the power input to the pump and means for increasing the current from the power source to the coaxial line in response to sensing of a pump power input that exceeds a given level indicative of flow impairment.

37. A mineral well heating system according to claim 1 for heating a well including a pump for pumping mineral fluid up through the production tubing, in which the control means includes a strain gauge mounted on a pump operating member.

38. A mineral well heating system according to claim 1, in a mineral well producing a viscous oil, in which the flow impairment temperature is the temperature at which the fluid viscosity requires at least one component of the pumping system of the well to exceed its design ratings and the upper limit temperature is the five centipoise point.

39. A mineral well heating system according to claim 4, in a well in which fluid from the reservoir collects in the annulus between the tubing and the casing, the system further comprising an electrical connector interconnecting the tubing and the well casing at a depth in the well below the level of fluid in the annulus.

40. A mineral well heating system according to claim 39, and further comprising an electrical insulator sleeve encompassing a portion of the tubing from the electrical connector to above the level of fluid in the annulus.

41. A mineral well heating system according to claim 40 and further comprising a thermal insulator sleeve encompassing at least a portion of the production tubing above the depth D.

42. A mineral well heating system according to claim 40 and further comprising an electrical insulator section interposed in the conductive casing adjacent the top of the reservoir.

43. A mineral well heating system according to claim 42 and further comprising an electrical insulator section interposed in the conductive casing adjacent the bottom of the reservoir.

44. A mineral well heating system according to claim 1, in a well in which fluid from the reservoir collects in the annulus between the well bore wall and the tubing, and the conductive well bore wall is electrically discontinuous at a given point near the top of the reservoir, the system further comprising an electrical insulator sleeve encompassing the production tubing from that given point to above the level of fluid in the annulus.

45. A well heating system for a mineral well of the kind in which a flow of a mineral fluid moving upwardly to a ground surface from a subterranean reservoir is subject to flow impairment due to condensation of paraffin or other condensible constituents from the fluid flow or to increasing viscosity of that fluid, caused by temperature reduction, the well comprising a well bore projecting downwardly from the ground surface to the fluid reservoir and an electrically conductive production tubing extending down into the well bore in physically spaced and electrically insulated relation to the well bore, the heating system comprising:

an alternating current electrical power source of given frequency f;

connection means for electrically connecting the power source to the tubing so that the tubing constitutes a part of a heating apparatus projecting downwardly through the well bore;

downhole connector means for electrically connecting a downhole portion of the tubing to the mineral fluid in the portion of the reservoir immediately encompassing the well bore;

and control means for controlling the electrical power supplied to the tubing from the power source to maintain the mineral fluid flowing in the tubing approximately at or above the flow impairment temperature for the fluid without substantially exceeding a predetermined upper limit temperature for the fluid in more than a minor fractional part of the tubing, in which the temperature limits are:

| content of mineral fluid | flow impairment temperature | upper limit temperature |
|---|---|---|
| paraffin | cloud point | paraffin melting point |
| sulfur | sulfur precipitation point | 300° F. |
| hydrates | crystal precipitation point | 300° F. |
| heavy, viscous oil | no-flow pour point | five centipoise temperature |

46. A mineral well heating system according to claim 45, in a well in which liquid from the reservoir collects in the annulus between the tubing and the well bore, to a given level above the downhole portion of the tubing, and further comprising an electrical insulator sleeve encompassing the tubing from above said given level down to the downhole portion of the tubing.

47. A mineral well heating system according to claim 45 and further comprising an electrically conductive downhole reservoir casing section encompassing the portion of the well bore in the reservoir, the downhole connector means comprising an electrical connector mounted on the downhole portion of the tubing and affording a molecular bond with the downhole reservoir casing section.

48. A mineral well heating system according to claim 47, in a well in which liquid from the reservoir collects in the annulus between the tubing and the well bore, to a given level above the reservoir casing section, and further comprising an electrical insulator sleeve encompassing the tubing from above said given level down to the level of the reservoir casing section.

49. A mineral well heating system according to claim 47, in which the reservoir casing section is physically connected to but electrically isolated from a conductive well casing that lines the well bore upwardly from a point a short distance above the reservoir casing section.

50. A mineral well heating system according to claim 49, in which the reservoir casing section is physically connected to but electrically isolated from a conductive well casing that lines the well bore downhole from a short distance below the reservoir casing section.

51. A mineral well heating system according to claim 50, in a well in which liquid from the reservoir collects in the annulus between the tubing and the well bore, to a given level above the reservoir casing section, and further comprising an electrical insulator sleeve encompassing the tubing from above said given level down to the level of the reservoir casing section.

52. A mineral well heating system according to claim 46, in a well having a conductive casing that lines the well bore above said given level, the conductive casing being terminated below said given level and the electrical insulator sleeve extending below the bottom of the conductive casing.

53. A well heating system for a mineral well of the kind in which a flow of a mineral fluid moving upwardly through the well is subject to impairment due to condensation of paraffin or other condensible constituents from the fluid flow or to increasing viscosity of that fluid, caused by temperature reduction, the well comprising a well bore projecting downwardly from a surface to a fluid reservoir and having an outer wall that is electrically conductive, and an electrically conductive production tubing extending down into the well bore in physically spaced and electrically insulated relation to the well bore wall, the heating system comprising:

a first electrical power source, comprising an alternating current source having a given frequency f;

a second electrical power source having a frequency much lower than f, down to D.C.;

connection means for electrically connecting both of the power sources to the tubing and to the electrically conductive wall so that the tubing and wall conjointly afford a two-conductor heating apparatus projecting downwardly into the well bore, which heating apparatus functions electrically approximately as a coaxial line, for both power sources;

and control means for controlling the electrical power supplied to the coaxial line from each of the power sources to maintain the mineral fluid flowing in the tubing approximately at or above the flow impairment temperature for the fluid without substantially exceeding a predetermined upper limit temperature for the fluid in more than a minor fractional part of the well;

whereby electrical power from the first source primarily heats the upper part of the well whereas electrical power from the second source primarily heats the downhole portion of the well;

in which the temperature limits are:

| content of mineral fluid | flow impairment temperature | upper limit temperature |
|---|---|---|
| paraffin | cloud point | paraffin melting point |
| sulfur | sulfur precipitation point | 300° F. |
| hydrates | crystal precipitation point | 300° F. |
| heavy, viscous oil | no-flow pour point | five centipoise temperature |

54. A mineral well heating system according to claim 53 in which the electrically conductive wall of the well bore comprises a cylindrical metal casing.

55. A mineral well heating system according to claim 54 in which the casing and the production tubing are both formed of a highly conductive metal such as aluminum.

56. A mineral well heating system according to claim 53 and further comprising a thermal insulator sleeve encompassing at least a portion of the production tubing in the upper part of the well.

* * * * *